US008267691B1

(12) United States Patent
Ferris et al.

(10) Patent No.: US 8,267,691 B1
(45) Date of Patent: Sep. 18, 2012

(54) THREAT FIRE SIMULATION AND TRAINING SYSTEM

(75) Inventors: Robert D. Ferris, Mesa, AZ (US); Roger D. Malin, Peoria, AZ (US)

(73) Assignee: Vitra Systems, Inc., Tempe, AZ (US)

( * ) Notice: Subject to any disclaimer, the term of this patent is extended or adjusted under 35 U.S.C. 154(b) by 0 days.

(21) Appl. No.: 13/230,834

(22) Filed: Sep. 12, 2011

Related U.S. Application Data

(63) Continuation-in-part of application No. 12/643,097, filed on Dec. 21, 2009, now Pat. No. 8,016,594, which is a continuation of application No. 11/286,162, filed on Nov. 22, 2005, now abandoned.

(60) Provisional application No. 60/633,080, filed on Dec. 3, 2004.

(51) Int. Cl.
*F41A 33/00* (2006.01)

(52) U.S. Cl. ..... 434/11; 434/199; 434/20; 434/21

(58) Field of Classification Search ..... 434/11, 434/16–22; 361/232
See application file for complete search history.

(56) References Cited

U.S. PATENT DOCUMENTS

| | | | | |
|---|---|---|---|---|
| 3,608,524 | A * | 9/1971 | Waltz | 119/718 |
| 5,215,465 | A * | 6/1993 | Marshall et al. | 434/22 |
| 5,815,077 | A * | 9/1998 | Christiansen | 340/573.3 |
| 5,826,578 | A * | 10/1998 | Curchod | 600/595 |
| 2006/0088801 | A1 * | 4/2006 | Eisenhauer et al. | 434/11 |

* cited by examiner

*Primary Examiner* — Xuan M. Thai
*Assistant Examiner* — Evan Page
(74) *Attorney, Agent, or Firm* — Wright Law Group, PLLC; Mark F. Wright

(57) ABSTRACT

A firearm training simulation system for simulating the impact of one or more projectiles impacting a user includes an electrical impulse element configured for physical contact with the user. A controller is in communication with the electrical impulse element. The controller enables receipt of a signal for activating the electrical impulse element to deliver one or more electrical pulses to the user. Each electrical pulse simulates an impact of a projectile on the user.

20 Claims, 5 Drawing Sheets

96

THREAT FIRE SIMULATION AND TRAINING SYSTEM

CROSS REFERENCE TO RELATED APPLICATIONS

The present application is a continuation-in-part of "Method of Training Utilizing a Threat Fire Simulation System," U.S. patent application Ser. No. 12/643,097, filed on 21 Dec. 2009, now U.S. Pat. No. 8,016,594 and which application is a continuation of "Threat Fire Simulation System," U.S. patent application Ser. No. 11/286,162, filed 22 Nov. 2005 now abandoned which application, in turn, claims priority under 35 U.S.C. §119(e) to "Simulated Shot-Back Training Device," U.S. Provisional Patent Application Ser. No. 60/633,080, filed 3 Dec. 2004, all of which are incorporated by reference herein.

BACKGROUND OF THE INVENTION

1. Field of the Invention

The present invention relates generally to the field of use-of-force training and more specifically relates to the simulation of a projectile, such as a bullet, impacting a trainee during training.

2. Related Art

Due to current world events, there is an urgent need for highly effective law enforcement, security, and military training Training involves practicing marksmanship skills with lethal and/or non-lethal weapons. Additionally, training involves the development of decision-making skills in situations that are stressful and potentially dangerous. Indeed, perhaps the greatest challenges faced by a trainee are when to use force and how much force to use. If an officer is unprepared to make rapid decisions under the various threats he or she faces, injury to the officer or citizens may result.

One training technique that has been in use for many years is the utilization of a simulation system to conduct training exercises. Simulation provides a cost effective means of teaching initial weapon handling skills and some decision-making skills, and provides training in real-life situations in which live-fire may be undesirable due to safety or other restrictions.

Simulation systems for such training have included devices to simulate the threat posed by an offender discharging a shot toward, and possibly impacting, a trainee. One such device is known as a shoot-back cannon. The shoot-back cannon discharges nylon balls at high velocity toward the trainee, with the nylon balls simulating bullets. Automatic targeting methods have been employed for directing the shoot-back cannon toward the trainee to reduce the instructor's burden of manually tracking and targeting the trainee. Training exercises typically involve teaching the trainee to seek cover.

One problem encountered with the shoot-back cannon is that due to the presence of high velocity nylon ball projectiles, the trainee must wear safety eye gear. The safety eye gear can have an adverse effect on the shooting accuracy of the trainee. Moreover, others in the area of the shoot-back cannon must also wear safety eye gear, generating both additional responsibility and liability for the training facility. Even with safety eye gear on, there is still the potential that the nylon ball projectile could injure the trainee or others, or damage equipment in the area. In addition, the nylon balls are a slipping hazard when on the floor because they can behave like ball bearings under the foot of an individual.

In addition to problems associated with safety, the shoot-back cannon could misfire or miss the intended target. When this happens, the training opportunity is lost. More critically, however, the trainee may consciously or subconsciously marginalize real-world threats.

Typically, the nylon balls are reused in the shoot-back cannon. Consequently, time intensive collection of the nylon balls is required. Finally, the shoot-back cannon is a mechanical device prone to mechanical breakdown and wear-and-tear over time, necessitating costly repair and/or replacement.

BRIEF SUMMARY OF THE INVENTION

A threat fire simulation system for simulating a projectile impacting a user includes an electrical impulse element configured for physical contact with the user. A controller is in communication with the electrical impulse element. The controller enables receipt of a signal for activating electrical impulse element to deliver a disabling or non-disabling electrical pulse to the user. The electrical pulse simulates an impact of the projectile on the user.

Accordingly, it is an advantage of the present invention that a system is provided for simulating a projectile impacting a user. For purposes of this disclosure, a simulated projectile may be a bullet, a piece of shrapnel (e.g., from an Improvised Explosive Device or "IED"), a rock, etc.

It is another advantage of the present invention that a system is provided in which a user can distinctly detect a simulated impact of a projectile.

Another advantage of the present invention is that a system is provided that is readily incorporated into a simulation system, is cost effectively manufactured, and calls for minimal adjustment by an instructor during a training exercise.

The above and other advantages of the present invention are carried out in one form by a system for simulating a projectile impacting a user. The system includes an electrical impulse element configured for physical contact with the user. A controller is in communication with the electrical impulse element for enabling receipt of a signal at the electrical impulse element. The signal activates the electrical impulse element to deliver one or more electrical pulses to the user, the electrical pulse simulating an impact of one or more projectiles.

BRIEF DESCRIPTION OF THE SEVERAL VIEWS OF THE DRAWINGS

The preferred embodiments of the present invention will hereinafter be described in conjunction with the appended drawings, wherein like designations denote like elements, and.

DETAILED DESCRIPTION OF THE INVENTION

The present invention entails a system for simulating conditions that may be utilized in conjunction with firearms training simulation systems. The simulation system is utilized in conjunction with a training scenario, with the scenario typically including an offender holding a weapon. The term "threat fire" utilized herein refers to a situation within the training scenario in which the offender discharges his or her weapon toward the trainee, i.e., the offender is a "threat" to the trainee's perceived safety. In at least one preferred embodiment of the present invention, the threat fire training and simulation system comprises a computer controlled simulation and training system, using a wide variety of readily available computer hardware and peripherals to provide simulated threat scenarios for the training of individuals, including, but not limited to, law enforcement and military personnel.

In at least one preferred embodiment of the present invention, the training scenario is a pre-recorded video sequence, including live actors and computer generated imagery (CGI) that is supplied to the end user in the form of electronic files (e.g., on DVD or other computer readable format) for use in firearms training. The pre-recorded video sequence of the training scenario is displayed to the trainee, presenting the trainee with a simulated environment that can be altered or adapted to meet the goals of the training exercise. For training purposes, the pre-recorded video sequence may be projected onto one or more video screens or, alternatively, projected onto a helmet visor or video display goggles donned by the trainee for a head-worn display system. With a head-worn display system, the use of video screens may be obviated, if desired.

In another preferred embodiment of the present invention, the training scenario comprises a live-action training session with simulated "force-on-force" trainees and participants using a wired or wireless communication link with standard laser-based training equipment, such as Multiple Integrated Laser Engagement System (MILES) and/or MILES 2000, which system and other similar systems are currently used by law enforcement agencies and military forces around the world. A laser-based training system, such as the MILES, provides tactical engagement simulation for direct fire force-on-force training using eye safe laser "bullets." This embodiment of the present invention may include pre-recorded video sequences but, in many cases, will be conducted in remote or isolated locations where video projection capabilities are limited or non-existent. In this case, the training scenario is typically a scripted attack or assault sequence using participants and trainees and various "real world" objects (e.g., buildings, vehicles, trees, etc.) to simulate the desired training environment.

Figure 1:
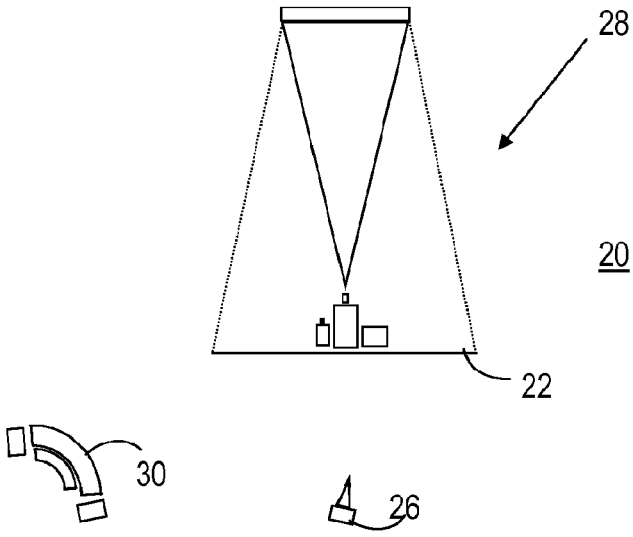
FIG. 1 shows a block diagram of a simulation system in which the present invention may be implemented.

FIG. 1 shows a block diagram of a simulation system 20 in which the present invention may be implemented. Simulation system 20 includes at least one screen 22, in front of which one or more participants, i.e., a trainee 26, may be positioned. A projection system 28 is associated with screen 22. Trainee 26 views screen 22 with video projected thereon via projection system 28, and must decide how to react to the subject matter presented within the video. Projection system 28 is operable, and the actions of trainee 26 may be monitored from, an instructor console 30 located a distance away from trainee 26. Instructor console 30 may comprise a tablet computer or other similar device.

The present invention is described in the context of its use with a single screen simulation system. It should be understood, however, that the specific simulation system is not a limitation of the present invention. Rather, the present invention may be readily implemented within a variety of existing and upcoming single screen and multiple screen simulation systems, including mixed-reality scenario training systems comprising screens and real world props such as mock cityscapes, doorways, windows, etc. as well as live actors used in addition to video playback of pre-recorded training scenarios.

Figure 2:
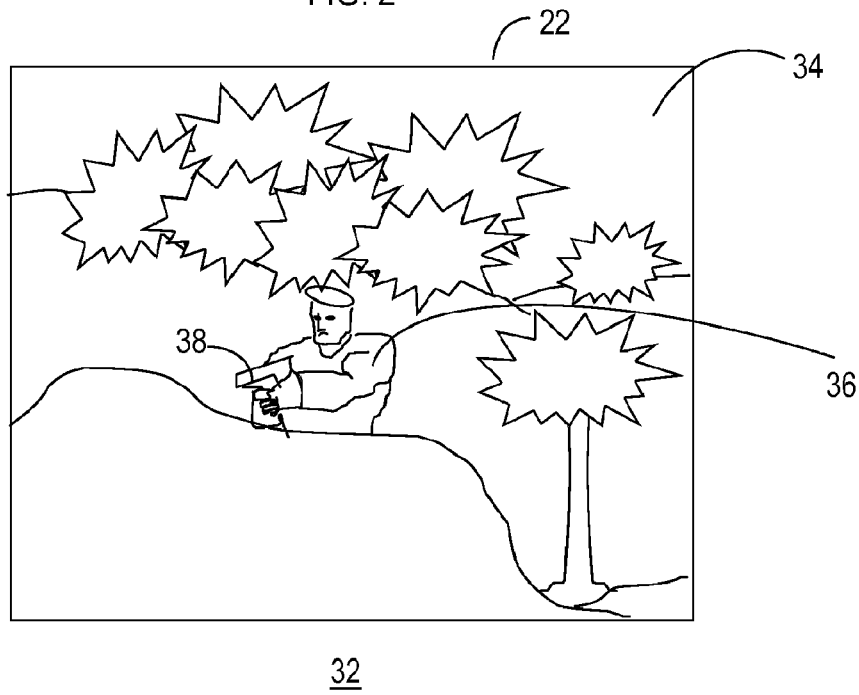
FIG. 2 shows an illustrative representation of a scene from a prerecorded video sequence, or scenario, that may be presented on a screen of the simulation system.

FIG. 2 shows an illustrative representation of a scene 32 from a prerecorded video sequence, or scenario 34, that may be presented on one or more screens 22 of simulation system 20 (FIG. 1). Scene 32 shows an offender 36 poised with a weapon 38 in hand. Trainee 26 (FIG. 1) must make a determination as to whether a shot from weapon 38 is imminent, and whether to shoot first or seek cover. For purposes of the following description, offender 36 discharges weapon 38. Although an actual projectile, or bullet, cannot discharge from weapon 38 of the prerecorded video of scenario 34, the present invention enables trainee 26 to experience the sensation of an impact of the projectile, so as to reinforce proper tactical decision-making.

Figure 3:
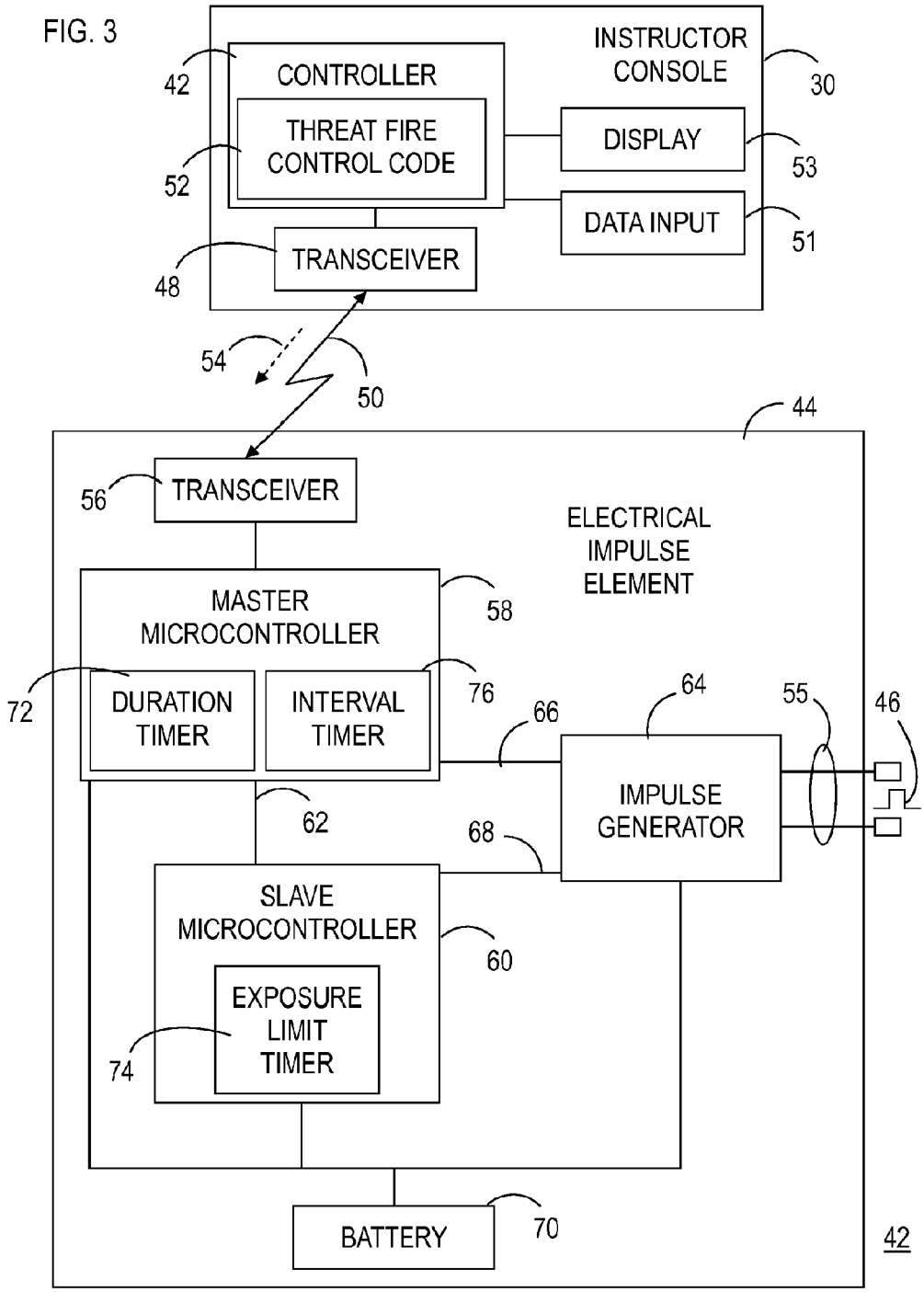
FIG. 3 shows a block diagram of a threat fire system for simulating a projectile impacting a user of the simulation system in accordance with a preferred embodiment of the present invention.

FIG. 3 shows a block diagram of a threat fire system 40 for simulating a projectile impacting trainee 26 in accordance with a preferred embodiment of the present invention. Threat fire system 40 is most preferably a computer controlled system that includes a controller 42 operable from instructor console 30 and an electrical impulse element 44 worn by trainee 26 (FIG. 1). Electrical impulse element 44 is configured for physical contact with trainee 26 (FIG. 1), directly or indirectly, as discussed below, and is configured to impart a disabling non-disabling electrical pulse 46 to trainee 26. The term "non-disabling" utilized herein refers to a condition in which trainee 26 can feel pulse 46 as a sensation of mild pain, or as a sensation of more severe pain in which trainee 26 may be temporarily removed from action. However, pulse 46 is not incapacitating, such as the pulse delivered by a conventional stun gun. Electrical pulse 46 simulates an impact of the simulated projectile fired from weapon 38 (FIG. 2) by offender 36 (FIG. 1). Thus, electrical pulse 46 serves as notification to trainee 26 that he or she has been "shot."

In at least one preferred embodiment of the present invention, instructor console 30 is a computer-based system that includes a computer monitor for viewing various user interface screens that allow the instructor to configure, monitor, and control the training simulation. Instructor console 30 typically includes a first, or instructor, transceiver 48 in communication with controller 42. Instructor transceiver 48 is in communication with electrical impulse element 44 via a communication link 50. In a preferred embodiment, communication link 50 is a wireless link. However, a wired communication link may alternatively be employed. Controller 42 executes threat fire control code 52, which is operable by an instructor (not shown this FIG.) via a data input 51, such as a keyboard, mouse, and the like, and is viewable by the instructor via a monitor or display 53. Threat fire control code 52 may be a stand-alone computer program or may be incorporated into primary control code (not shown) for controlling the general operation of simulation system 20 (FIG. 1). Through the execution of threat fire control code 52, controller 42 generates and conveys a signal, represented by a dashed arrow 54, to electrical impulse element 44. Signal 54 enables activation of electrical impulse element 44, discussed below, to deliver non-disabling electrical pulse 46 to trainee 26 via a pair of electrodes 55, positioned at one or more locations.

Via instructor transceiver 48, the instructor can monitor the actions of trainee 26 and in communication with electrical impulse element 44 via a communication link 50 and the instructor can determine when and if a non-disabling electrical pulse 46 should be delivered to trainee 26. For example, in a training exercise where trainee is required to "take cover" in order to prevent exposure to hostile conditions, the instructor can activate electrical impulse element 44 and deliver non-disabling electrical pulse 46 to trainee 26 if trainee 26 does not "take cover" in an appropriate period of time.

Electrical impulse element 44, worn by trainee 26 (FIG. 1) includes a second, or trainee, transceiver 56 for receiving signal 54 via wireless communication link 50. A master microcontroller 58 is in communication with transceiver 56. Master microcontroller 58 is further in communication with a slave microcontroller 60 via a link 62. In addition, master microcontroller 58 selectively communicates with an impulse generator 64 via a first power lead 66. Similarly, slave microcontroller 60 selectively communicates with impulse generator 64 via a second power lead 68. Master microcontroller 58, slave microcontroller 60, and impulse generator 64 are powered by a rechargeable battery 70.

Impulse generator 64 may be a conventional stunner circuit capable of producing a 20,000 to 150,000 volt pulse, or shock. The internal circuit of a conventional stunner circuit is typically based either on an oscillator, resonant circuit and step-up transformer or diode-capacity voltage multipliers to achieve a continuous, direct or alternating high-voltage discharge.

Such stunner weapons may be utilized in law enforcement environments for subduing a person by administering a high-voltage, but low-current electrical shock. An electrical shock of sufficient duration provided by the stunner weapon "confuses" the human nervous system, thus incapacitating an individual. The high voltage is needed to transfer the electrical charge to the individual's body, and the current is kept low so that the individual will not be severely injured.

In the training environment of simulation system 20, impulse generator 64 does not produce the incapacitating shock of a conventional stunner weapon. Rather, a high voltage electrical pulse 46 is produced for a very brief duration, discussed below. The high voltage of electrical pulse 46 is critical so that pulse 46 may be felt through the clothing of trainee 26. However, the short duration mitigates the potential for incapacitating trainee 26 (FIG. 1).

Safety interlocks are important for the safe training application of system 40. Such safety interlocks may include watchdog processors that monitor for any component failure. If the watchdog processors detect a failure or problem, impulse generator 64 cannot be activated. In another preferred embodiment of the present invention, electrical impulse elements 44 may be automatically disabled by one or more sensors associated with electrical impulse elements 44. For example, an altimeter, a global positioning sensor ("GPS" sensor), an accelerometer, a moisture sensor, or other similar sensor may be incorporated into simulation system 20. In this preferred embodiment of the present invention, impulse elements 44 will be communicatively coupled to at least one or more disabling sensors.

Accordingly, when trainee 26 is standing on an elevated perch, platform, ladder, etc., the altimeter or GPS sensor would detect the potential for injury due to the distance above the ground. Although the electrical impulse generated by impulse elements 44 is generally non-disabling, the sudden exposure to the electrical simulation may startle trainee 26. If trainee 26 is in a precarious position or location, the trainee may be momentarily distracted and lose balance, etc. Similarly, if the moisture sensor detects a high level of moisture in the ambient surroundings, it can automatically disable the electrical impulse elements 44 until the moisture level is within an acceptable range. By temporarily disabling electrical impulse elements 44 based on the trainee's physical location, the safety of the training environment can be enhanced.

Threat fire system 40 includes a duration timer 72 communicatively coupled to and managed by master microcontroller 58 for monitoring a duration of activation of non-disabling electrical pulse 46, i.e., a delivery duration. Under normal operating conditions, delivery of pulse 46 is discontinued upon expiration of the delivery duration, as monitored at duration timer 72. Threat fire system 40 further includes a secondary exposure limit timer 74 managed by slave microcontroller 60. Exposure limit timer 74 ensures that the duration does not exceed a pre-programmed value, for example two and one half seconds. Should delivery of pulse 46 not be discontinued upon expiration of the delivery duration, as monitored at duration timer 72, delivery of pulse 46 will be discontinued when the duration reaches the pre-preprogrammed value, monitored at exposure limit timer 74. Thus, the dual timer capability of duration timer 72 and exposure limit timer 74 provides another safety interlock for limiting injury to trainee 26 (FIG. 1).

In addition, system 40 includes an interval timer 76 managed by master microcontroller 58. Interval timer 76 is utilized for controlling an interval between delivery of successive electrical pulses 46. Through the utilization of interval timer 76, electrical impulse element 44 will not reactivate for a set period after impulse generator 64 was last activated. Interval timer 76 may be set to, for example, fifteen seconds. Consequently, interval timer 76 provides yet another safety interlock for limiting injury to trainee 26.

In general operation, signal 54, in the form of a serial digital message, is sent from controller 42 over wireless communication link 50 via instructor transceiver 48. Ideally, the generation of signal 54 is coordinated with actions unfolding in scenario 34. For example, signal 54 may be automatically generated by controller 42 in response to an action in which offender 36 (FIG. 2) discharges weapon 38 (FIG. 2) when a period of time has elapsed and trainee 26 has not yet appropriately reacted to the situation. Alternatively, the instructor can "manually" activate electrical impulse element 44 from instructor console 30 (FIG. 3) via a program control window displayed on display 53 when offender 36 discharges weapon 38 and trainee 26 has not yet sought cover.

Signal 54 is received at trainee transceiver 56, is decoded, and is forwarded to master microcontroller 58. Signal 54 includes an identifier specifying electrical impulse element 44, a "pain setting" in the form of a delivery duration for non-disabling electrical pulse 46, and a CHECKSUM.

Master microcontroller 58 performs a validity check of signal 54 using CHECKSUM to determine whether errors occurred in transmission of signal 54 over wireless link 52. Master microcontroller 58 further authenticates the identifier specifying electrical impulse element 44 and determines whether the transmitted delivery duration is a logical value. If signal 54 is invalid, master microcontroller 58 ignores signal 54 and nothing happens.

However, if signal 54 is valid, master microcontroller 58 returns an acknowledge signal to controller 42 via wireless communication link 50. Master microcontroller 58 then applies power to first power lead 66 and commands slave microcontroller 60 via link 62 to apply power to second power lead 68. In addition, master microcontroller 58 starts duration timer 72 and starts interval timer 76.

In response to commanding from master microcontroller 58, slave microcontroller 60 returns an acknowledge signal to master microcontroller 58 via link 62, applies power to second power lead 68, and starts secondary exposure limit timer 74.

Power applied to first and second power leads 66 and 68, respectively, enables activation of impulse generator 64 to produce and deliver non-disabling electrical impulse 46 at pair of electrodes 55. Master microcontroller 58 commands slave microcontroller 60 to remove power from second power lead 68 when duration timer 72 expires to discontinue delivery of non-disabling electrical pulse 46. If slave microcontroller 60 fails to receive appropriate commanding within the pre-programmed value monitored by exposure limit timer 74, slave microcontroller 60 removes power from second power lead 68 to impose a forced discontinuation of the delivery of electrical pulse 46.

Although threat fire system 40 is shown as having only one electrical impulse element 44, it should be understood that controller 42 can control a number of individual electrical impulse elements 44. These multiple electrical impulse elements 44 can be physically coupled at various locations on trainee 26. For example, one of elements 44 could be coupled to the primary shooting arm of trainee 26. As such, should element 44 be activated, trainee 26 may be compelled to utilize his or her non-dominant arm. Alternatively, these multiple electrical impulse elements 44 can be physically coupled to multiple trainees 26 concurrently training in simulation system 20 (FIG. 1).

Figure 4:
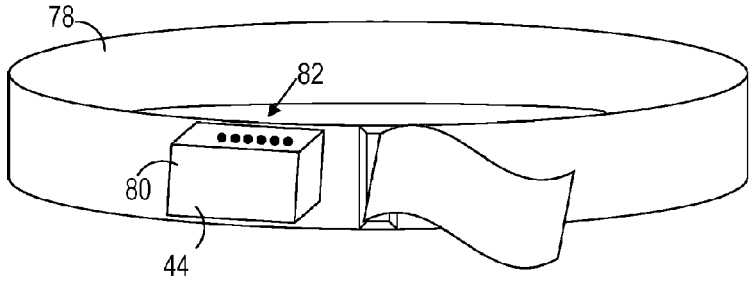
FIG. 4 shows a perspective view of an electrical impulse element of the threat fire system of FIG. 3 mounted on a user worn belt.
Figure 5:
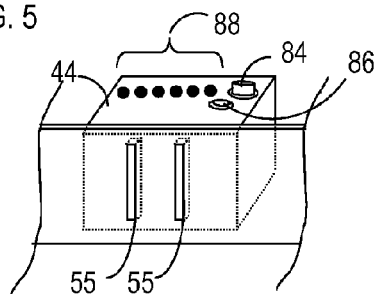
FIG. 5 shows a partial rear perspective view of the electrical impulse element mounted on the user worn belt.
Figure 6:
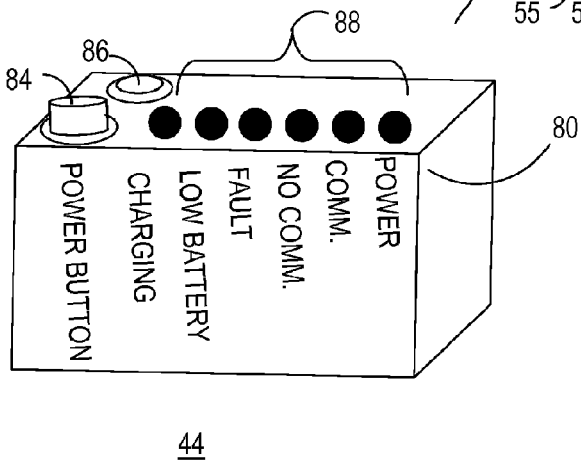
FIG. 6 shows a perspective view of the electrical impulse element.

Referring now to FIG. 4, FIG. 5, and FIG. 6, FIG. 4 shows a perspective view of electrical impulse element 44 of threat fire system 40 (FIG. 3) mounted on a user worn belt 78. FIG. 5 shows a partial rear perspective view of the electrical impulse element 44 mounted on user worn belt 78, and FIG. 6 shows a perspective view of the electrical impulse element 44.

The elements of electrical impulse element 44 are contained in a housing 80, which is in turn coupled to belt 78. Belt 78 provides means for securing electrical impulse element 44 to trainee 26 (FIG. 1). Pair of electrodes 55 are imbedded in a user facing side 82 of belt 78 so that electrodes 55 can be placed in physical contact with trainee 26. Although electrodes 55 are in physical contact with trainee 26, electrodes 55 need not contact the trainee's skin. For example, electrodes 55 may include thin wires sewn into user facing side of belt 78 for ensuring that non-disabling electrical pulse 46 is felt by trainee 26 through the clothing of trainee 26. Although described herein as a "pair of electrodes" the actual implementation of electrodes 55 is any type of conductive mechanism known to those skilled in the art that is capable of delivering the electrical impulse as described herein.

Further, in certain preferred embodiments of the present invention, electrodes 55 may be affixed to or embedded into a T-shirt or other garment worn by trainee 26, obviating the need for an external connection. This also allows for an increased numbers of electrical impulse elements 44 that do not need to be attached in a piece-meal fashion, as well as providing for more accurate correlation (e.g., increased granularity) between the actions of trainee 26 and the simulated impact created by electrical impulse elements 44. In another preferred embodiment of the present invention, one or more electrical impulse elements 44 may be embedded into a grip portion of a simulated weapon. In this fashion, there is no need for attaching electrodes 55 to trainee 26, since non-disabling electrical pulse 46 may be delivered to the grip portion of the simulated weapon.

Non-disabling electrical pulse 46 (FIG. 3) from electrodes 55 is capable of penetrating four or more layers of clothing (approximately one half inch of thickness), so that belt 78 can be conveniently placed on top of the clothing worn by trainee 26. Although belt 78 is shown with only one electrical impulse element 44 mounted thereon, belt 44 might include two elements 44 such that one is positioned in front of trainee 26 and one is positioned in the back.

Once belt 78 is secured with electrodes 55 in contact with trainee 26, electrical impulse element can be turned "on" via a pushbutton 84 located on an external surface of housing 80. In addition to pushbutton 84, housing 80 includes a charging port 86 for recharging battery 70 (FIG. 3) and a number of indicator lights 88. In an alternative embodiment, port 86 may be absent. In such a case, electrical impulse element 44 may be recharged via an inductive charge technique or may include non-rechargeable batteries. Indicator lights 88 include, for example, a "CHARGING" light that when blinking indicates that element 44 is charging and a "LOW BATTERY" light that when lit indicates that it's time to recharge element 44. Indicator lights can also include a "FAULT" light that when lit indicates a component failure within element 44, a "NO COMM" light that when lit indicates that there is no communication link between element 44 and controller 42 (FIG. 3), a "COMM" light that when lit that a communication link is present between element 44 and controller 42, and a "POWER" light that when lit indicates that power is currently on.

Figure 7:
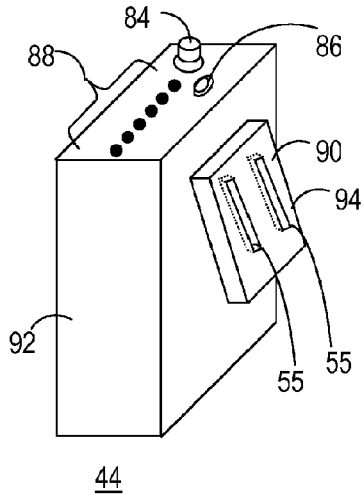
FIG. 7 shows a perspective view of the electrical impulse element of the threat fire system that attaches to the user via a clip in accordance with an alternative embodiment of the present invention.

FIG. 7 shows a perspective view of electrical impulse element 44 of threat fire system 40 (FIG. 3) that attaches to trainee 26 (FIG. 1) via a clip 90 in accordance with an alternative embodiment of the present invention. The elements of electrical impulse element 44 are contained in a housing 92, to which clip 90 is coupled. Clip 90 may be a conventional spring clip that provides means for securing electrical impulse element 44 to trainee 26 (FIG. 1). Pair of electrodes 55 may be imbedded in a user facing side 94 of clip 92 so that electrodes 55 can be placed in contact with trainee 26.

Multiple housings 92 may be secured to trainee 26 via clips 90 at various locations, such as in the front, back, and on each bicep. In this manner, the instructor could activate controller 42 to enable receipt of signal 50 (FIG. 3) at any of electrical impulse elements 44 contained in housings 92, thus simulating shots impacting at various locations on trainee 26.

Figure 8:
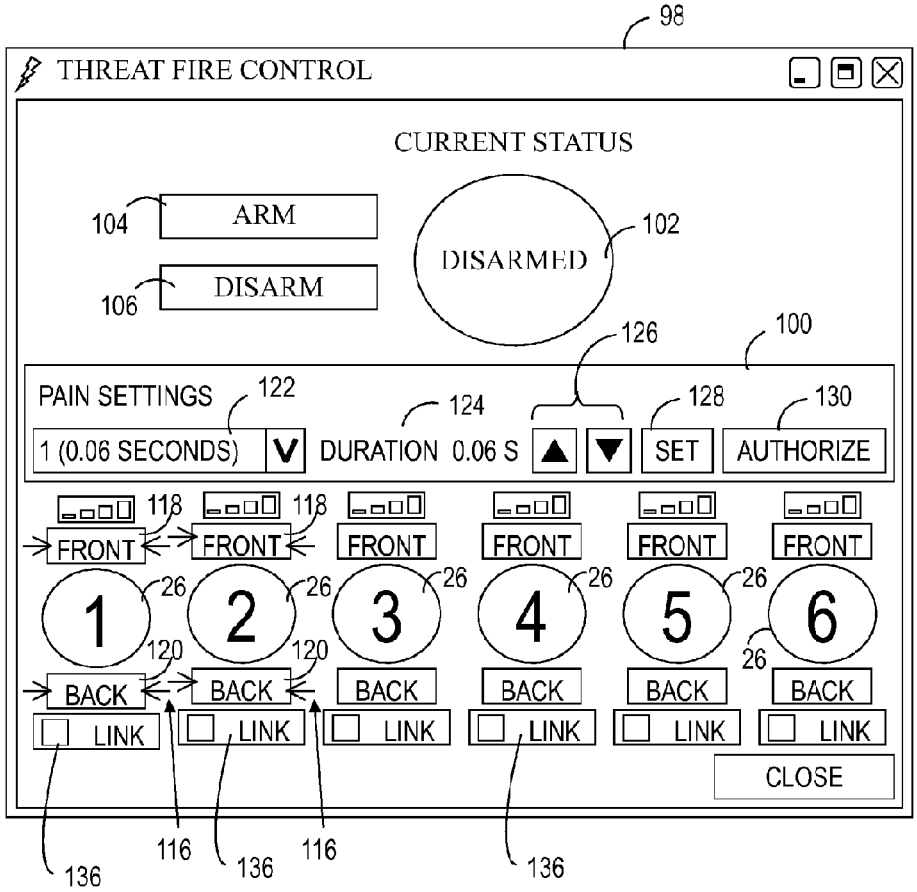
FIG. 8 shows a computer monitor screen shot image of a main window presented on a display of an instructor console.

FIG. 8 shows a screen shot image 96 of a main window 98 presented on display 51 (FIG. 3) of instructor console 30 (FIG. 3). Main window 98 is the primary opening view when a "threat fire control command" is selected on a main menu of the primary control code that controls the general operation of simulation system 20 (FIG. 1). Main window 98 includes a pain settings window 100 and a number of user fields, referred to as buttons, for determining the behavior of electrical impulse element 44 (FIG. 3). A secondary monitor (e.g. tablet screen) may also be deployed to display and activate the electrical pulse for one or more trainees.

Main window 98 opens with threat fire system 40 (FIG. 3) disarmed, as indicated by a current status indicator 102. Interactive buttons within main window can include an "arm"

button 104 and a "disarm" button 106. To arm threat fire system 40, the instructor clicks on arm button 104. In response a pop up window of a password entry pane will be revealed.

Figure 9:
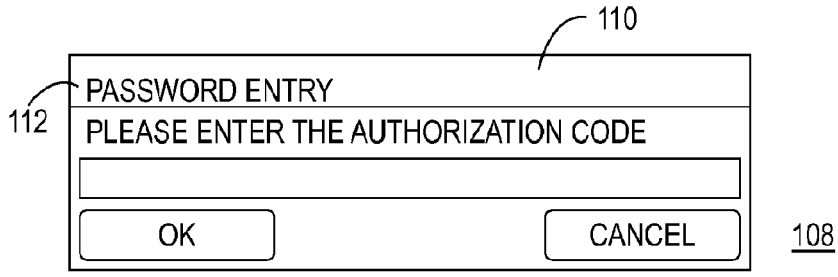
FIG. 9 shows a computer monitor screen shot image of a pop up window revealing a password entry pane.

FIG. 9 shows a screen shot image 108 of an exemplary pop up window 110 revealing a password entry pane 112. Per conventional procedures, the instructor is asked for an authorization password. After the instructor enters the authorization password and clicks "OK" in password entry pane 112, threat fire system 40 is armed.

Figure 10:
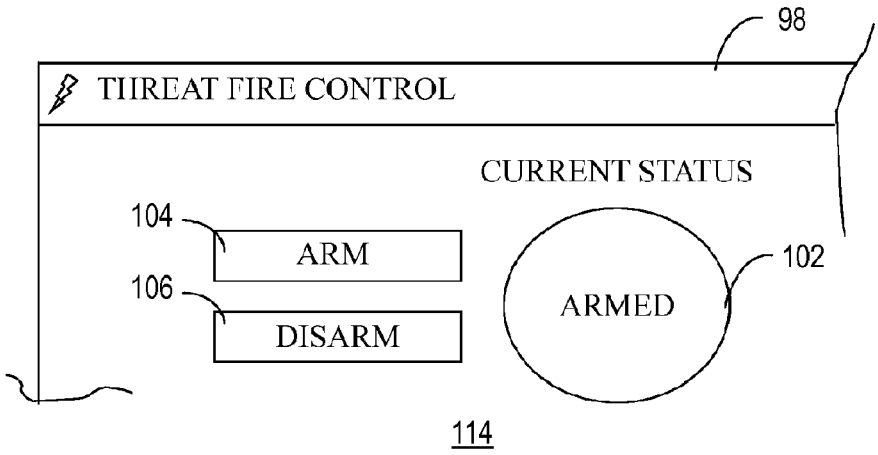
FIG. 10 shows a partial computer monitor screen shot image of the main window with the threat fire system prepared for operation.

FIG. 10 shows a partial screen shot image 114 of main window 98 with threat fire system 40 prepared for operation. Once armed, current status indicator 102 switches from "disarmed", as in FIG. 8 to "armed" as in FIG. 10.

Referring once again to FIG. 8, once threat fire system 40 is armed, controller 42 will connect via wireless communication link 50 (FIG. 3) to one or more available electrical impulse elements 44 (FIG. 3), and the individual controls for each of elements 44 will be enabled as appropriate.

In the exemplary illustration of FIG. 8, controller 42 can be enabled to communicate with up to twelve electrical impulse elements 44, that is two elements 44 (FRONT and BACK) for each of six trainees 26, labeled 1-6. FRONT indicates placement of one of electrical impulse elements 44 on the front of trainee 26, and BACK indicates placement of one of electrical impulse elements 44 on the back of trainee 26.

In this exemplary illustration, the connection of controller 42 with electrical impulse elements 44 is represented by outwardly radiating lines 116 about a FRONT button 118 and a BACK button 120 for each of two trainees 26, represented by the trainee identifiers "1" and "2" in main window 98. Although radiating lines 116 are shown herein, in an actual display, front button 118 and back button 120 may be normally colored red, and their color switches to green to indicate connection of controller 42 with particular impulse elements 44.

By utilizing pain settings window 100, the instructor can adjust pain settings for each of electrical impulse elements 44. The pain sensed by trainee 26 subjected to non-disabling electrical pulse 46 (FIG. 3) is affected by the delivery duration of pulse 46. A longer delivery duration results in a sensation of greater pain. Conversely, a shorter delivery duration of pulse 46 results in a sensation of less pain. In a group training exercise, the delivery duration could be extended to a greater length, such as, the exposure limit monitored by exposure limit timer 74 (FIG. 3). This lengthened duration, although non-disabling, may briefly put trainee 26 out of action, thereby simulating a situation in which trainee 26 is removed from combat.

Pain settings window 100 includes a duration select drop down menu 122, a duration readout field 124, and UP/DOWN buttons 126 to manually adjust the pain setting. In addition, pain settings window 100 includes a "SET" button 128 and an "AUTHORIZE" button 130 to enable the settings to change.

Figure 11:
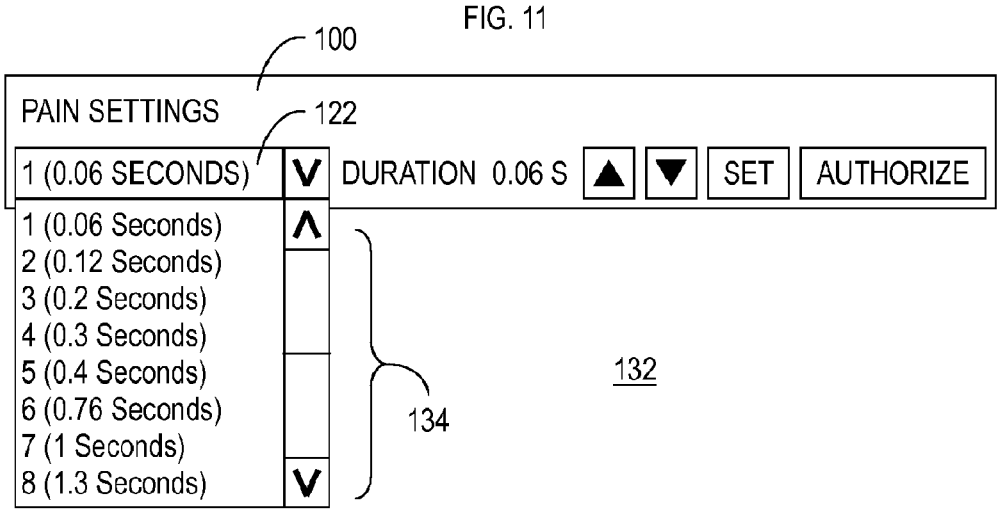
FIG. 11 shows a computer monitor screen shot image of a drop down menu of that includes a list of default pain settings.

FIG. 11 shows a screen shot image 132 of drop down menu 122 that includes a list of default pain settings 134. A pain setting 134 selected from drop down menu 122 is the number of seconds, or fractions of a second, (i.e., a duration) that non-disabling electrical pulse 46 (FIG. 3) will be delivered.

With reference back to FIG. 8, in general operation, the instructor may initially click on authorize button 130 to enter an authorization code (not shown). The instructor may then either change the pain setting to one of a number of default settings using drop down menu 122 or may manually adjust the pain setting using UP/DOWN buttons 126. Once the pain settings are adjusted, the instructor may optionally click on set button 128 that disables adjustment of the pain settings. As such, the pain settings cannot be re-adjusted without first entering the authorization code, again providing another safety interlock for protecting trainee(s) 26 from injury.

To fire, or activate, any of electrical impulse elements 44, an instructor can simply click any of the active front and back buttons 118 and 120, indicated herein by outwardly radiating lines 116. This will fire a desired one of electrical impulse elements 44 at the desired one of pain settings 134 and at the desired location.

If more than one trainee 26 is utilizing simulation system 20 (FIG. 1) to train concurrently within scenario 34 (FIG. 2), multiple elements 44 can be activated concurrently using a link feature. For example, checking two or more of link check boxes 136 enables all of the selected elements to fire when one of the front or back buttons 118 and 120, respectively, are clicked. For example, if link check boxes 136 are checked for two trainees 26, represented by the trainee identifiers "1" and "2", and front button 118 is clicked on trainee 26, represented by "2", then both elements 44 associated with front button 118 for both trainees 26, represented by the trainee identifiers "1" and "2", will activate. Thus, non-disabling electrical pulse 46 (FIG. 3) will be delivered to both trainees.

In the embodiment described above, controller 42 (FIG. 3) generates and transmits signal 54 over communication link 50 to electrical impulse element 44. Upon validation, signal 54 activates impulse generator 64 (FIG. 3) of electrical impulse element 44 to deliver non-disabling electrical pulse 46 (FIG. 3), pulse 46 simulating an impact of a projectile from weapon 38 (FIG. 2) discharged by offender 36 (FIG. 2) within scenario 34 (FIG. 2). Alternatively, in certain preferred embodiments of the present invention, the electrical pulse may simulate an exploding IED or shrapnel from an anti-personnel mine or other explosive device.

In an alternative preferred embodiment of the present invention, electrical impulse element 44 may interface via a wired or wireless communication link with standard laser-based training equipment, such as Multiple Integrated Laser Engagement System (MILES) and/or MILES 2000, which system and other similar systems are currently used by law enforcement agencies and military forces around the world. A laser-based training system, such as the MILES, provides tactical engagement simulation for direct fire force-on-force training using eye safe laser "bullets". When the present invention is employed in combination with MILES gear, controller 42 (FIG. 3) may be employed to arm threat force system 40 (FIG. 3), thus enabling receipt of an activation signal at electrical impulse element 44. However, the activation signal is actually generated and transmitted from the MILES gear.

For example, when the MILES gear registers a lethal hit, the MILES gear could transmit an activation signal via a wired or wireless communication link to electrical impulse element 44. This activation signal could then trigger impulse generator 64 (FIG. 3) to deliver non-disabling electrical pulse 46 (FIG. 3). Sensation of pulse 46 can give a trainee a more realistic sense and negative feedback of being "virtually" killed in action during training. A non-lethal shot could be set to trigger a very short pulse 46, whereas a "kill" could trigger a more pronounced pulse 46.

When electrical impulse element 44 is utilized in cooperation with MILES gear, pain settings 134 (FIG. 11) would not be adjustable by the trainees in the field. In addition, if a soldier attempted to remove element 44, element 44 could be set in a mode to activate a "dead" setting of the MILES gear, to deter tampering. Another option may be to have element 44 equipped with a sensor that triggers when element 44 is removed from the soldier, thereby letting element 44 register an event of tampering. Conversely, such an element should include authorization capability for allowing an authorized individual to remove element 44 from the soldier.

In addition, when electrical impulse element 44 is utilized in cooperation with MILES gear, Trainee 26 may be participating in a simulated live action drill or training session. In this case, trainee 26 is not viewing a video sequence on a screen but is, instead, viewing other trainees and participants wearing MILES gear and reacting to "real world" events as they unfold in the training scenario. In this environment, trainee 26 must decide how to react to the subject matter presented within the live action scenario. The laser "bullets" of the MILES system will activate electrical impulse element 44 whenever an opponent or other participant registers a "hit" on the trainee, as detected by the MILES laser engagement sensors. In this fashion, it is not necessary to have a video screen or an instructor console for activating electrical impulse element 44.

Aspects of the threat fire simulation and training system are described herein with reference to various microcontrollers, screens, and related computer program products. It will be understood that the command and control functions of the system described herein can be implemented by computer program instructions, executed by the master microcontroller (central processing unit or "CPU") in conjunction with the slave microcontroller and other related hardware components. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the control and operation of the threat fire system of the present invention.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the control and operation of the threat fire system of the present invention. The article of manufacture may include distribution via CD or DVD, for example, to be used in conjunction with a computer system to adapt the computer system to be used as a platform for implementing the threat fire simulation and training system of the present invention. In at least one preferred embodiment of the present invention, the article of manufacture comprises software (e.g., computer program instructions) stored on a computer readable storage medium that may be distributed to users of the threat fire system of the present invention.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the control and operation of the threat fire system of the present invention.

Additionally, various preferred embodiments of the program product may be configured to: create and modify multiple user and scenario databases; track, update and store data relative to specific simulations and training programs; configure and implement various search and retrieve functions for a plurality of search requests and determinations made by users of the threat fire simulation and training system; track and store information about various trainees; update and transmit search results to one or more users; and provide one or more user interfaces for accomplishing all of these functions. Various preferred embodiments may also include a plurality of structures that are disclosed herein in singular form, or a single structure disclosed herein as a plurality; those skilled in the art will recognize when this may be effective for some embodiments.

In the most preferred embodiments of the present invention, multiple video cameras or video monitors may be positioned in the training area. This will allow the instructors to record the activity of the trainees during the training simulation. The timing of the electrical impulses, as well as the trainee's response to the training scenario and the electrical impulses can also be captured for later review and analysis.

In summary, the present invention teaches a threat fire system for simulating a projectile impacting a user. The threat fire system delivers a non-disabling electrical pulse from an electrical impulse element coupled to a trainee so that the trainee can distinctly detect a simulated impact of a projectile. The non-disabling electrical pulse provides a more realistic sense and negative feedback of being "shot" in action during a simulation training exercise. Since the electrical impulse elements are coupled to the trainees, at no time does the instructor need to take aim, thereby greatly simplifying the instructor's burden during a training exercise. Moreover no actual projectiles or laser projectiles are utilized for threat fire simulation, thereby reducing the potential for injury to the trainee. More than one electrical impulse element can be coupled at various locations on a single trainee and/or trainees to maximize the impact of the training experience. Furthermore, the threat fire system is readily incorporated into a variety of single screen and multiple screen simulation systems and its circuitry is relatively cost effective for manufacturing.

From the foregoing description, it should be appreciated that use-of-force training and projectile simulation system disclosed herein presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. A threat fire simulation system comprising:

a training scenario displayed to at least one user;

at least one electrical impulse element, the at least one electrical impulse element comprising:

a housing containing an impulse generator; and a pair of electrodes in electrical communication with each of the impulse generator and the at least one user; and at least one non-disabling electrical pulse generated by the impulse generator, the at least one non-disabling electrical pulse simulating an impact of a projectile, the at least one non-disabling electrical pulse being selectively delivered to the user via the pair of electrodes in response to at least one user reaction to the training scenario displayed to the at least one user.

2. The threat fire simulation system of claim 1 wherein:

the electrical impulse element further comprises a clip coupled to an outer surface of the housing, the clip being attached to the at least one user; and wherein the pair of electrodes are imbedded in a user contact side of the clip, and wherein the electrode impulse element is attached to the at least one user at a pre-determined location to simulate a shot fired from a weapon impacting the pre-determined location.

3. The threat fire simulation system of claim 1 wherein the electrical impulse element further comprises a clip coupled to an outer surface of the housing, the clip being attached to the at least one user.

4. The threat fire simulation system of claim 1 wherein the at least one electrical impulse element comprises a plurality of electrical impulse elements, wherein each of the electrical impulse elements comprises:

a housing containing an impulse generator; and a pair of electrodes in electrical communication with each of the impulse generators and the at least one user;

a clip coupled to an outer surface of the housing, the clip being attached to the user; and wherein each of the pair of electrodes for each of the plurality of electrical impulse elements are imbedded in a user contact side of the clip, and wherein each of the plurality of electrode impulse elements is attached to the at least one user at a plurality of pre-determined locations to simulate a shot fired from a weapon impacting one of the plurality of pre-determined locations.

5. The threat fire simulation system of claim 1 wherein the at least one user comprises a plurality of users and wherein the training scenario is displayed to a plurality of users, and wherein each of the plurality of users is in contact with at least one electrical impulse element, the at least one electrical impulse elements comprising:

a housing containing an impulse generator; and a pair of electrodes in electrical communication with each of the impulse generators and one of the at least one users; and wherein each of the impulse generators generates at least one non-disabling electrical impulse, each of the at least one non-disabling electrical pulses simulating an impact of a projectile, each of the at least one non-disabling electrical pulses being selectively delivered to at least one of the plurality of users via the pair of electrodes attached to each of the plurality of users in response to at least one user reaction exhibit by each of the plurality of users to the displayed training scenario.

6. The threat fire simulation system of claim 1 wherein at least one non-disabling electrical pulse generated by the impulse generator comprises one of a first delivery duration and a second delivery duration, wherein the first delivery duration and the second delivery duration are unequal.

7. The threat fire simulation system of claim 1 further comprising:

instructor console; and a communication link, the communication link connecting the instructor console to the at least one at least one electrical impulse element.

8. The threat fire simulation system of claim 7 wherein the communication link comprises a wireless communication link.

9. The threat fire simulation system of claim 1 further comprising:

a master microcontroller;

a duration timer communicatively coupled to the master microcontroller, the duration timer controlling an exposure duration for the at least one non-disabling electrical pulse; and a secondary exposure limit timer, the secondary exposure timer limiting the exposure duration for the at least one non-disabling electrical pulse.

10. The threat fire simulation system of claim 1 wherein the video sequence comprises at least one of a plurality of simulated threat scenarios, the plurality of simulated threat scenarios comprising:

a simulated threat scenario including an offender poised with a weapon;

a simulated threat scenario wherein the offender discharges the weapon; and a simulated threat scenario including a plurality of offenders with a plurality of weapons.

11. The threat fire simulation system of claim 1 wherein the at least one non-disabling electrical pulse delivers a sensation of pain to the at least one user.

12. The threat fire simulation system of claim 1 further comprising a laser-based training system integrated with the threat fire simulation system, the laser-based training system comprising:

a torso harness worn by the user, the torso harness comprising at least one infrared detector;

a simulated weapon that outputs a level of infrared energy;

a device activation signal based on the detection of the level of infrared energy by the at least one infrared detector; and a non-disabling electrical pulse generated in response to the device activation signal, the non-disabling electrical pulse being delivered to the user.

13. The threat fire simulation system of claim 1 further comprising at least one safety interlock, the at least one safety interlock being selected from the group comprising an altimeter, a GPS sensor, a moisture sensor, and an accelerometer, the at least one safety interlock preventing an unwanted generation of the non-disabling electrical pulse.

14. A computer controlled threat fire simulation and training system comprising:

a plurality of screens, the plurality of screens displaying a plurality of video sequences to a plurality of users, and wherein each of the plurality of users is in contact with at least one electrical impulse element, each of the at least one electrical impulse elements comprising:

a housing containing an impulse generator; and a pair of electrodes in electrical communication with each of the impulse generators and one of the at least one users; and wherein each of the impulse generators generates at least one non-disabling electrical impulse, each of the at least one non-disabling electrical pulses simulating an impact of a projectile, each of the at least one non-disabling electrical pulses being selectively delivered to at least one of the plurality of users via the pair of electrodes attached to each of the plurality of users in response to at least one user reaction exhibit by each of the plurality of users to the video sequence displayed on the screen;

a plurality of safety interlocks, the plurality of safety interlocks preventing an unwanted generation of at least one of the non-disabling electrical pulses generated by at least one of the electrical impulse elements;

an instructor console; and a wireless communication link, the wireless communication link connecting the instructor console to the plurality of electrical impulse elements.

15. The threat fire simulation system of claim 14 further comprising at least one safety interlock, the at least one safety interlock being selected from the group comprising an altimeter, a GPS sensor, and an accelerometer, the at least one safety interlock preventing an unwanted generation of the non-disabling electrical pulse.

16. The threat fire simulation system of claim 14 wherein the plurality of video sequences comprises a plurality of simulated threat scenarios, the plurality of simulated threat scenarios comprising:

a simulated threat scenario including an offender poised with a weapon;

a simulated threat scenario wherein the offender discharges the weapon; and a simulated threat scenario including a plurality of offenders with a plurality of weapons.

17. The threat fire simulation system of claim 16 further comprising:

a master microcontroller;

a duration timer communicatively coupled to the master microcontroller, the duration timer controlling an exposure duration for the at least one non-disabling electrical pulse; and a secondary exposure limit timer, the secondary exposure timer limiting the exposure duration for the at least one non-disabling electrical pulse.

18. An article of manufacture comprising software stored on a computer readable storage medium, the software comprising a user interface allowing a user to control and direct a threat fire simulation system, the threat fire simulation system comprising:

at least one video sequence displayable to at least one user;

at least one electrical impulse element, the at least one electrical impulse element comprising:

a housing containing an impulse generator; and a pair of electrodes in electrical communication with each of the impulse generator and the at least one user; and at least one non-disabling electrical pulse generated by the impulse generator, the at least one non-disabling electrical pulse simulating an impact of a projectile, the at least one non-disabling electrical pulse being selectively delivered to the user via the pair of electrodes in response to at least one user reaction to the video sequence displayed on the screen.

19. The article of manufacture of claim 18 wherein the software further comprises a control program for controlling a duration and an intensity of the at least one non-disabling electrical pulse generated by the impulse generator.

20. The article of manufacture of claim 18 wherein the software further comprises a plurality of simulated threat scenarios.

* * * * *